US010463137B2

(12) United States Patent
Simione

(10) Patent No.: US 10,463,137 B2
(45) Date of Patent: Nov. 5, 2019

(54) BACKPACK FRAME

(71) Applicant: Jason Simione, Stuart, FL (US)

(72) Inventor: Jason Simione, Stuart, FL (US)

(73) Assignee: Redsled, Inc., Dania Beach, FL (US)

( * ) Notice: Subject to any disclaimer, the term of this patent is extended or adjusted under 35 U.S.C. 154(b) by 0 days.

(21) Appl. No.: 15/906,376

(22) Filed: Feb. 27, 2018

(65) Prior Publication Data

US 2018/0303227 A1 Oct. 25, 2018

Related U.S. Application Data

(60) Provisional application No. 62/464,225, filed on Feb. 27, 2017.

(51) Int. Cl.
*A45F 3/08* (2006.01)

(52) U.S. Cl.
CPC ..... *A45F 3/08* (2013.01)

(58) Field of Classification Search
CPC ..... A45F 3/00; A45F 3/04; A45F 3/08; A45F 3/10; Y10S 224/907; B63C 2011/026
USPC ..... 224/633
See application file for complete search history.

(56) References Cited

U.S. PATENT DOCUMENTS 3,233,803 A * 2/1966 Gray ..... A45F 3/04 224/153
3,774,825 A * 11/1973 Schone ..... A45F 3/10 224/262
3,938,718 A * 2/1976 Madison ..... A45F 3/10 224/262
4,135,654 A * 1/1979 Chu ..... A45F 3/08 224/261
4,298,149 A * 11/1981 Gottschalk ..... A45F 3/10 224/201
4,582,165 A * 4/1986 Latini ..... A01M 31/02 108/152
4,676,418 A * 6/1987 Lowe ..... A45F 3/08 224/262
4,750,654 A * 6/1988 Menetrier ..... A45F 3/04 224/262
4,830,245 A * 5/1989 Arakaki ..... A45F 3/04 2/2.5

(Continued)

*Primary Examiner* — Brian D Nash
(74) *Attorney, Agent, or Firm* — Fleit Gibbons Gutman Bongini Bianco PL; Jon Gibbons

(57) ABSTRACT

The backpack frame includes a substantially polygon main member with a set of horizontally-oriented-oval-shaped slots and a set of vertically-oriented-oval-shaped slots. At least some of the set of vertically-oriented-oval-shaped slots separate the horizontally-oriented oval-shaped slots. The substantially polygon main member includes a top end and a bottom end, the bottom end forming an obtuse angle with the top end, the bottom end including a set of mounting tabs disposed in a substantially perpendicular direction thereto. Each of the set of mounting tabs has a set of oval-shaped-slots and at least one circular slot. In one example the substantially polygon main member of the backpack frame has three top sides forming three sides forming a substantially octagon shape. Reinforcement brackets can be fastened by any fastening means to at least two of the three sides of the substantially octagon shape include a reinforcement bracket.

11 Claims, 9 Drawing Sheets

(56) References Cited

U.S. PATENT DOCUMENTS 4,842,173 A * 6/1989 Scherer ..... A45F 3/047 224/631
4,934,573 A * 6/1990 Jaeger ..... A45F 3/08 224/153
5,131,576 A * 7/1992 Turnipseed ..... A45F 3/08 224/262
5,361,955 A * 11/1994 Gregory ..... A45F 3/04 224/630
5,366,126 A * 11/1994 Dausien ..... A45F 3/04 224/630
5,553,759 A * 9/1996 McMaster ..... A45F 3/08 224/259
5,564,612 A * 10/1996 Gregory ..... A45F 3/08 224/633
5,878,928 A * 3/1999 Seiber ..... A45F 3/04 224/153
5,954,253 A * 9/1999 Swetish ..... A45F 3/08 224/628
D426,700 S * 6/2000 Gregory ..... D3/216
6,536,641 B1 * 3/2003 Sundara ..... A45F 3/08 224/631
6,857,820 B2 * 2/2005 Jacoway ..... B63C 11/02 224/627
D507,697 S * 7/2005 Seong ..... D3/216
7,644,847 B2 * 1/2010 Howell ..... A45F 3/08 224/628
7,703,645 B2 * 4/2010 Moskun ..... A45F 3/08 224/579
7,793,809 B2 * 9/2010 Howell ..... A45F 3/10 224/261
D653,324 S * 1/2012 Townsend ..... D24/110
8,398,337 B2 * 3/2013 Jablonski ..... A45F 3/10 405/187
D691,792 S * 10/2013 Robert ..... D3/216
9,350,408 B2 * 5/2016 Cipolla ..... H04B 1/3827
9,872,794 B2 * 1/2018 Ingimundarson ..... A61F 5/028
2006/0163305 A1 * 7/2006 Tong ..... A45F 3/08 224/628
2006/0289589 A1 * 12/2006 Gregory ..... A45F 3/047 224/631
2008/0257928 A1 * 10/2008 Lowry ..... A45F 3/04 224/638
2015/0344089 A1 * 12/2015 Bopanna ..... B62J 9/00 224/430

* cited by examiner

BACKPACK FRAME

CROSS-REFERENCE TO RELATED APPLICATIONS

This application is based upon and claims priority from U.S. Provisional Patent Application No. 62/464,225, filed on Feb. 27, 2017, the entire disclosure of which is herein incorporated by reference.

BACKGROUND OF THE INVENTION

The present invention generally relates to the field of backpacks, and more particularly relates to the field of backpack frame systems.

Backpacks have been used for many years to carry equipment. A wide variety of equipment including weapons, radios, clothing, food, medical and other provisions are carried in backpacks.

SUMMARY OF THE INVENTION

Disclosed is a novel a backpack frame system. The backpack frame includes a substantially polygon main member with a set of horizontally-oriented-oval-shaped slots and a set of vertically-oriented-oval-shaped slots. At least some of the set of vertically-oriented-oval-shaped slots separate the horizontally-oriented oval-shaped slots. The substantially polygon main member includes a top end and a bottom end, the bottom end forming an obtuse angle with the top end, the bottom end including a set of mounting tabs disposed in a substantially perpendicular direction thereto. Each of the set of mounting tabs has a set of oval-shaped-slots and at least one circular slot.

In one example the substantially polygon main member of the backpack frame has three top sides forming three sides forming a substantially octagon shape. Reinforcement brackets can be fastened by any fastening means to at least two of the three sides of the substantially octagon shape include a reinforcement bracket.

In another example, the backpack frame system includes an auxiliary substantially rectangular member with a set of a set of horizontally-oriented oval-shaped slots and a set of vertically-oriented-oval-shaped slots. At least some of the vertically-oriented-oval-shaped slots separate the horizontally-oriented-oval-shaped slots, the auxiliary rectangular member including a side tabs disposed in a substantially perpendicular direction thereto. Each of the side tabs has a set of oval-shaped-slots and at least one circular slot disposed in pattern to axially align with at least one of the oval-shaped-slots and the circular slot of the set of mounting tabs so when mounted it can swing through a ninety degree rotation.

The backpack frame and the auxiliary substantially rectangular member can be composed of metal, composite, plastic, or a combination thereof.

BRIEF DESCRIPTION OF THE DRAWINGS

The accompanying figures wherein reference numerals refer to identical or functionally similar elements throughout the separate views, and which together with the detailed description below are incorporated in and form part of the specification, serve to further illustrate various embodiments and to explain various principles and advantages all in accordance with the present invention, in which.

DETAILED DESCRIPTION

As required, detailed embodiments of the present invention are disclosed herein; however, it is to be understood that the disclosed embodiments are merely examples of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure and function. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms "including" and/or "having", as used herein, are defined as comprising (i.e., open language). The term "coupled", as used herein, is defined as connected, although not necessarily directly, and not necessarily mechanically. The term fastening means includes soldering, brazing, welding, glue, epoxy, and mechanical fasters such as bolts, screws and riveting or any combination thereof.

Figure 1:
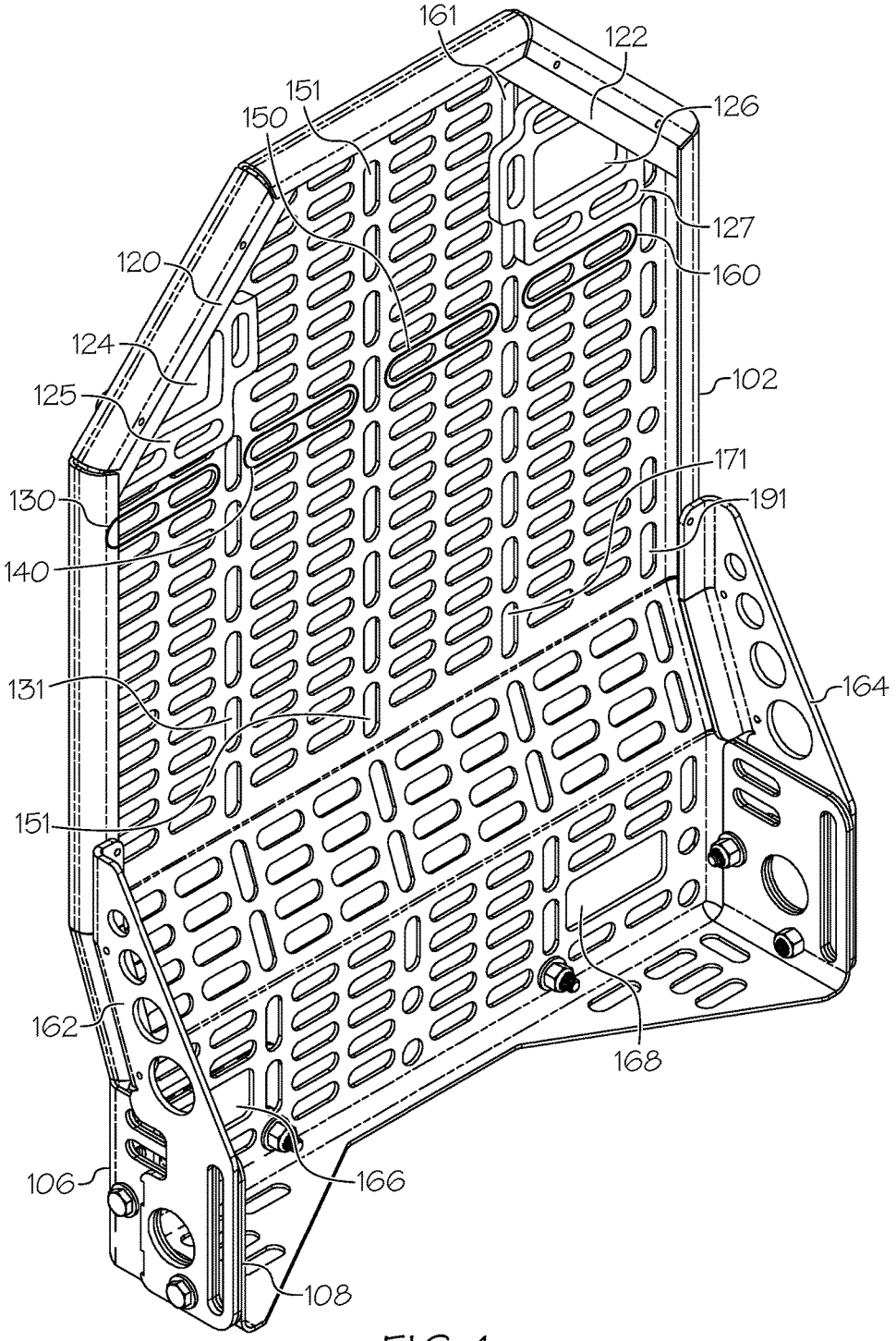
FIG. 1 is a perspective view of the backpack frame
Figure 3:
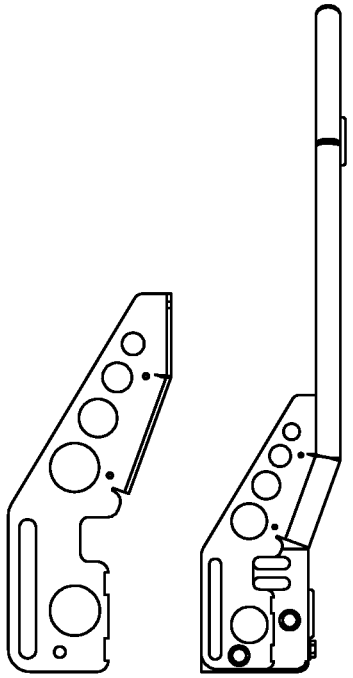
FIG. 3 is a side elevational view thereof.

Turning now to FIG. 1 is a perspective view 100 of the backpack frame 102. There is an outer frame border is shown on the top, right and left hand sides. The top portion of the outer frame forms three sides of a polygon shape. More specifically, the top portion of the outer frame forms three sides of an octagon as shown. The dimensions of the frame in one example is approximately 20 inches in height, 15 inches wide and about ¾ inch depth. Around 14 inches from the top, the bottom portion 104 of the frame at slopes out about 20 degrees as shown in FIG. 3. Shown is a pair of mounting tabs 106. An edge 108 of the mounting tabs 106, are in a coplanar arrangement with the edge of the backpack frame 102. The set of mounting tabs 106 have slots 310, and one or more circular openings 320, 330 as shown in FIG. 3.

The frames can be fabricated from metal, composite, plastic, or a combination thereof.

The backpack frame 102, in one example is fabricated out of a single piece of lightweight metal such as aluminum. The edges are bent over. The edges may be further secured by any fastening means including soldering, brazing, welding, riveting, screws, or bolts.

In one example two sides of the top polygon shape 120, 122 are reinforced by fastening to the edges which are bent over. Also the set of mounting tabs 106 are reinforced with side supports 162, 164 that can be mechanically fasten to the backpack frame 102 using any fastening means.

Sets 130, 140, 150, 160 series of pairs of horizontally-oriented-oval-shaped slots separated by series of vertically-oriented-oval-shaped slots 131, 151, 171, 191 are shown. The exact number of slots and sets of slots can vary depending on the overall dimensions of the frame.

Figure 7:
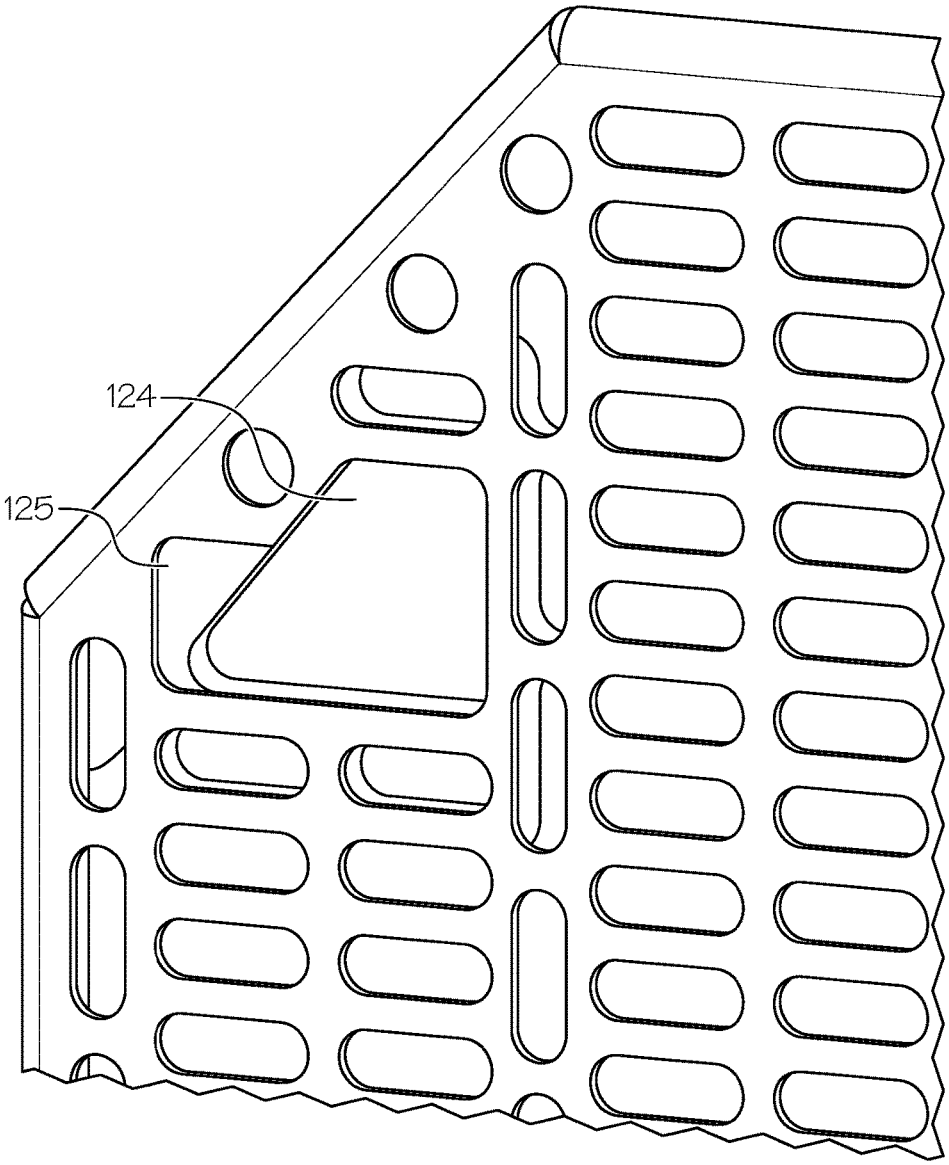
FIG. 7 is a elevational view of the top-left portion of FIG. 2 illustrating the opening detail from a first side.
Figure 8:
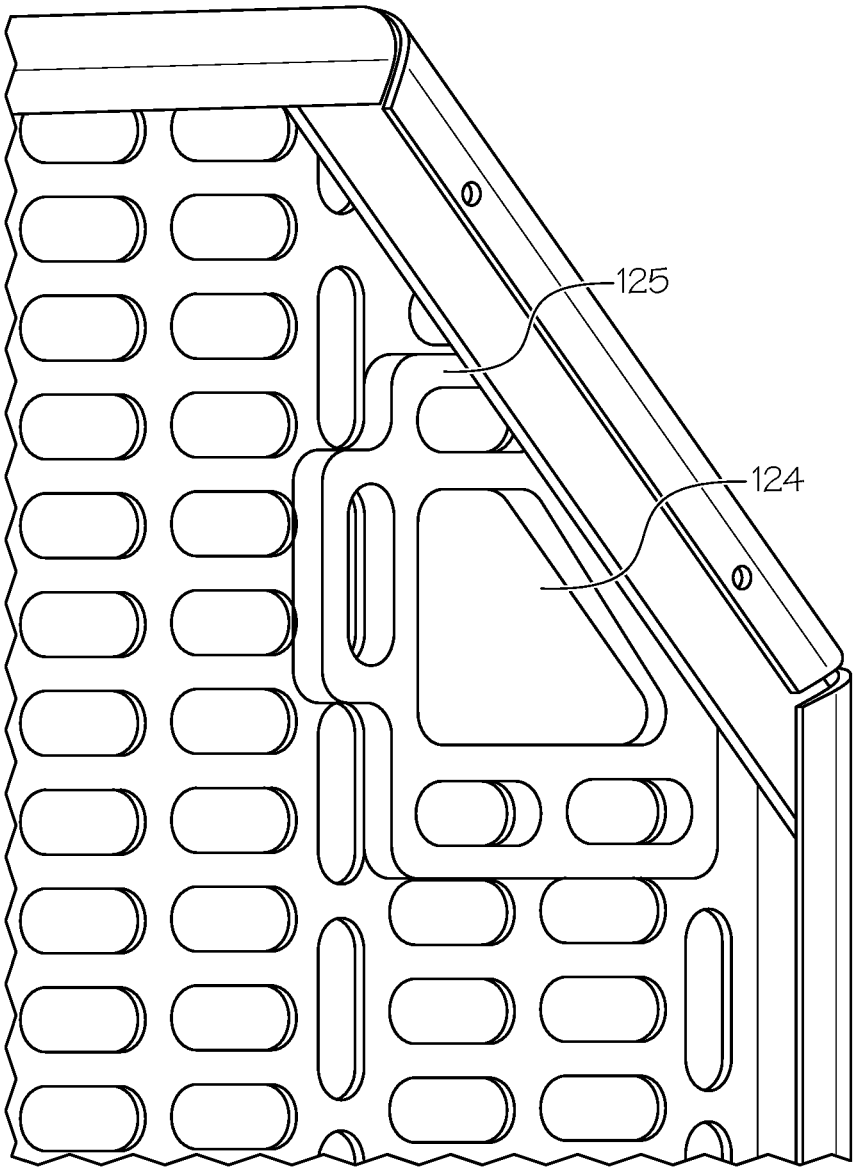
FIG. 8 is a elevational view of the top-left portion of FIG. 2 illustrating the opening detail from a second side.

Also shown are two large openings 124, 126 formed in the top as shown to accommodate larger straps. The large opening may include reinforcement guides 125, 127. These reinforcement guides 125, 127 are shown in FIG. 7 and FIG. 8. The reinforcement guides 194, 196 can be secured to the backpack frame 102 using any fastening means. In another example the backpack frame includes to two larger opening 166 and 168 in the bottom as shown.

Figure 2:
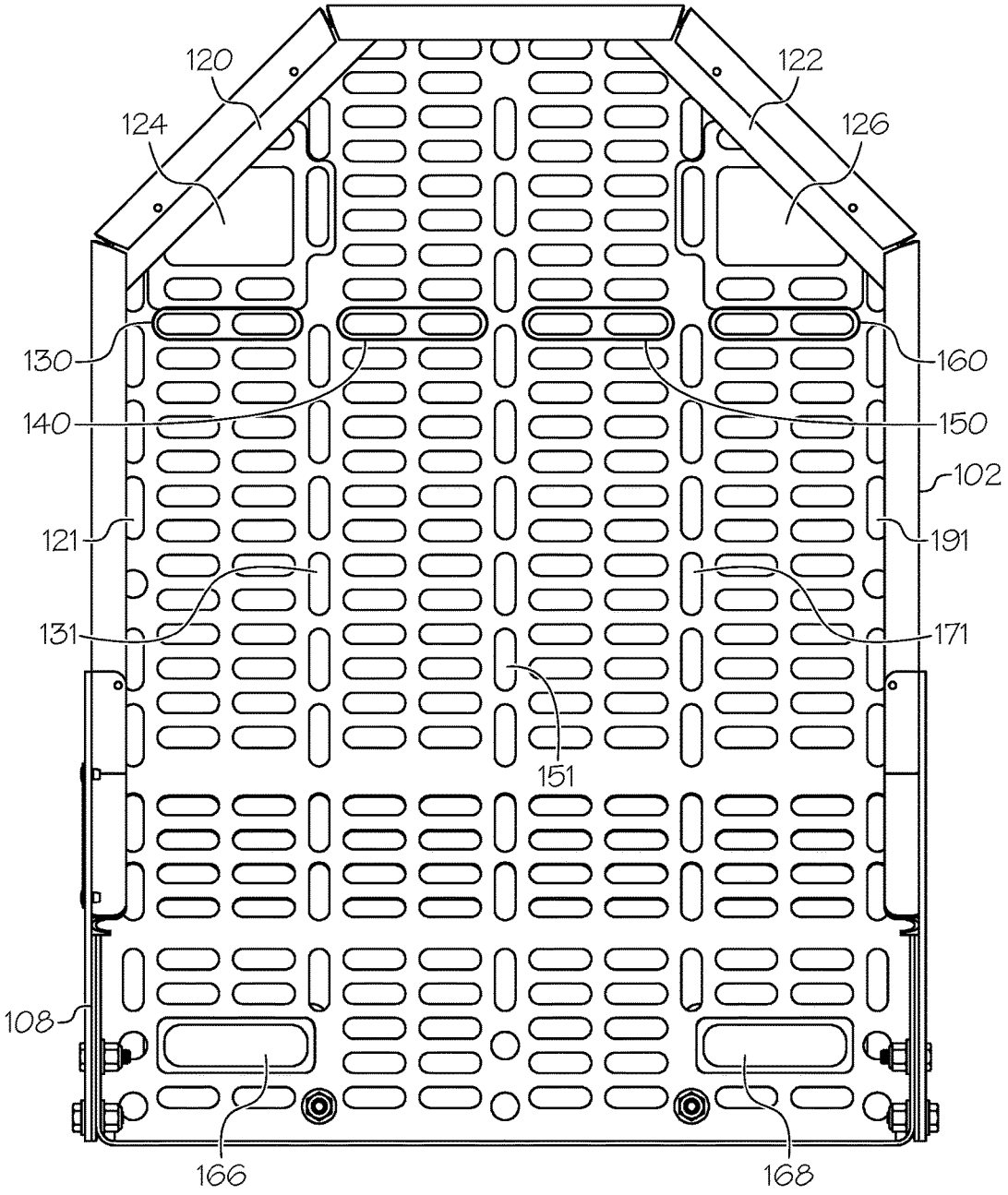
FIG. 2 is a first elevational view thereof.
Figure 4:
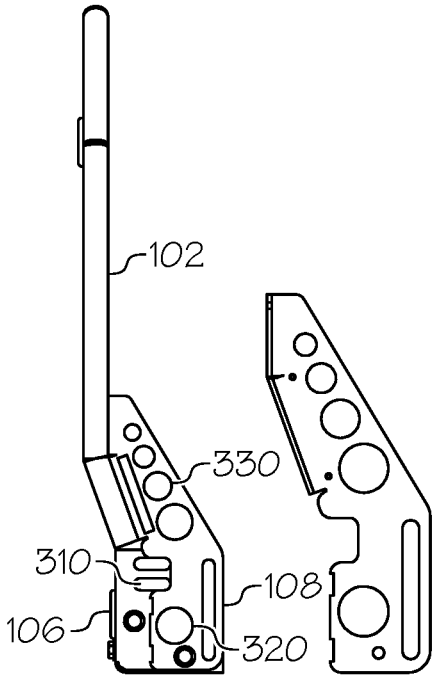
FIG. 4 is a second elevational view thereof.
Figure 5:
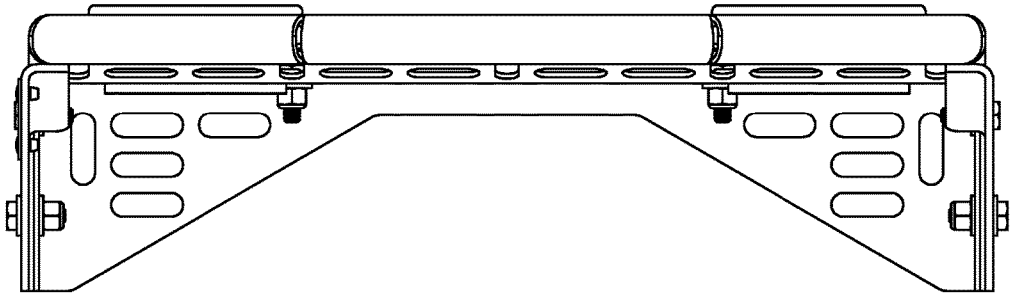
FIG. 5 is a bottom elevational view thereof.
Figure 6:
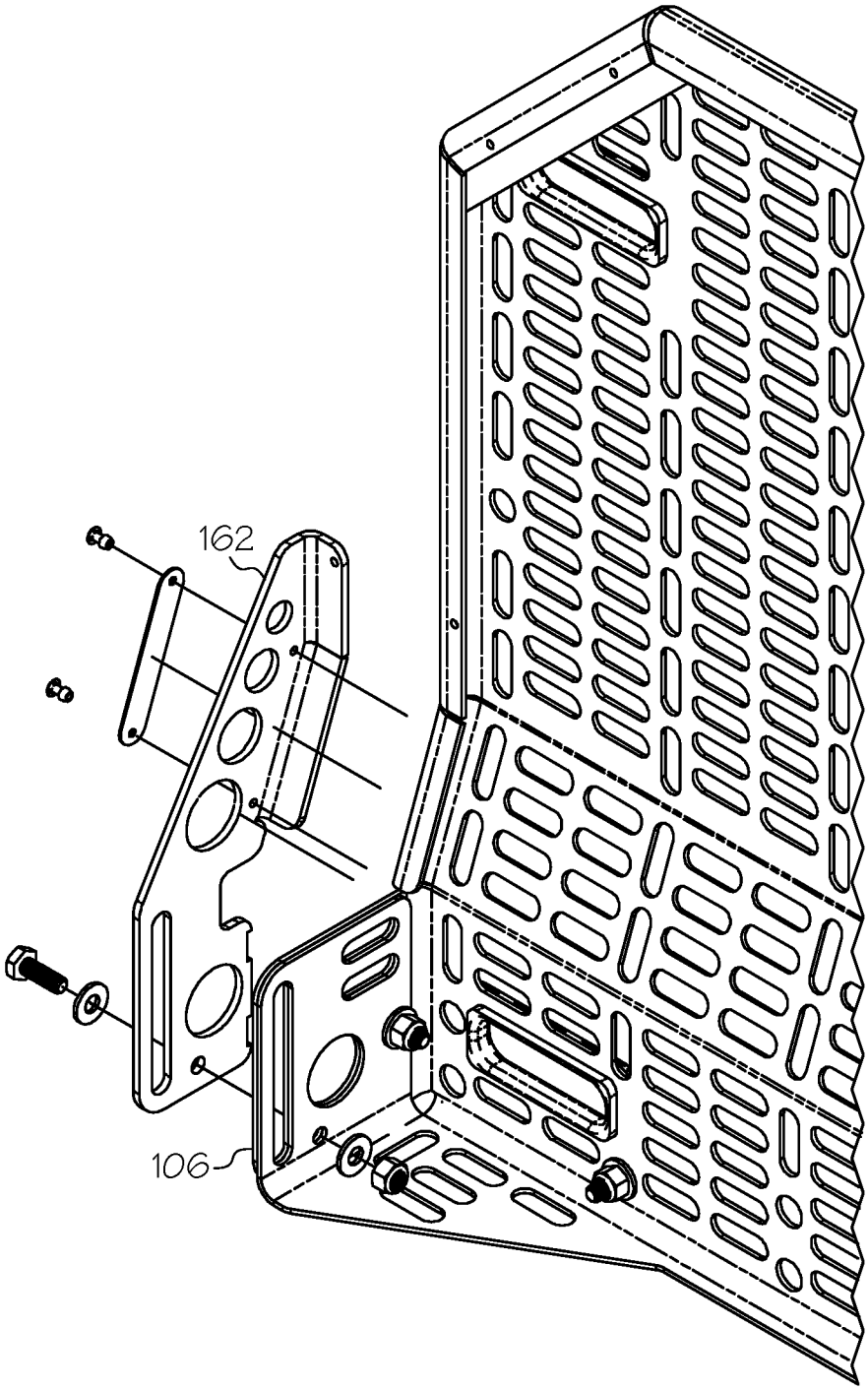
FIG. 6 is another perspective view showing illustrating the bottom reinforcing bracket.

FIG. 2 is a first elevational view thereof and FIG. 4 is a second elevational view thereof illustrating the horizontally oriented oval shaped slots. FIG. 3 is a side elevational view thereof showing the frame sloping out about 30% of the length at the bottom along with the tabs. FIG. 5 is a bottom elevational view thereof. FIG. 6 is a sectional view thereof.

Figure 9:
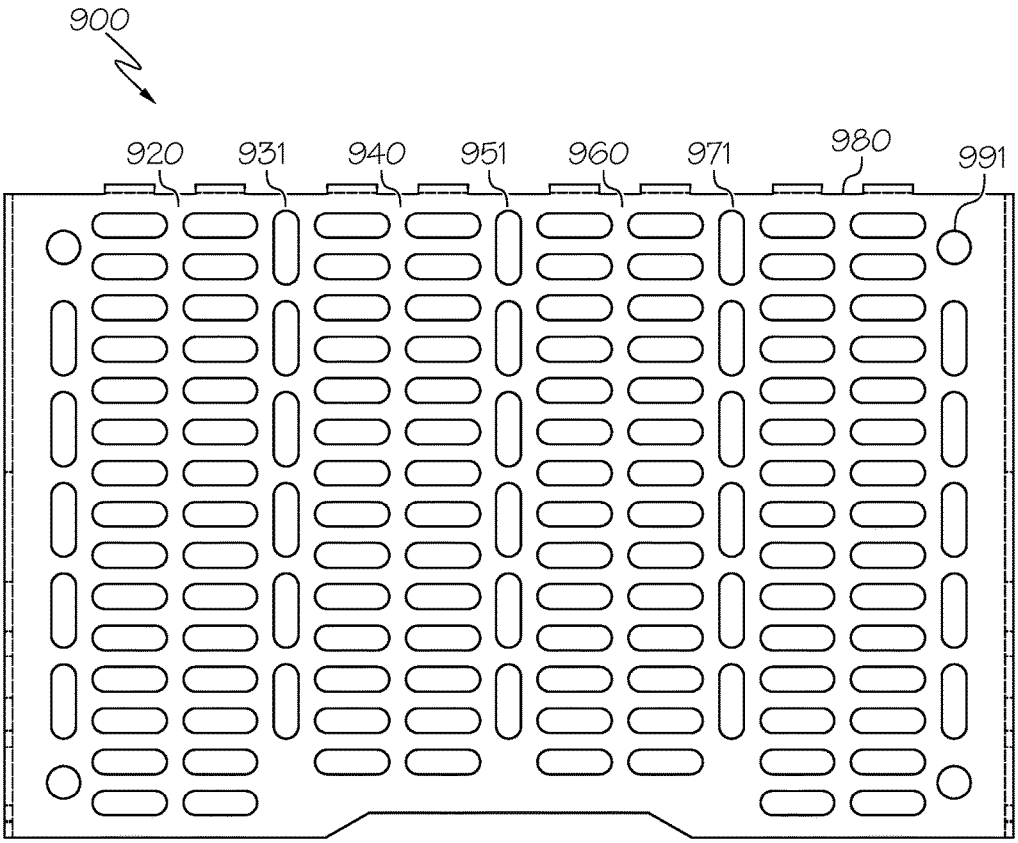
FIG. 9 is a perspective view of a platform extension.

FIG. 9 is a perspective view of a platform extension 900. The platform is about 15 inches wide and 10 inches long. It is design to be rotatable mounted to the set of mounting tabs 106 in the backpack frame 102. The platform extension 900 is designed to be rotatable through an approximately a ninety degree rotation with respect to the backpack frame 102.

Figure 10:
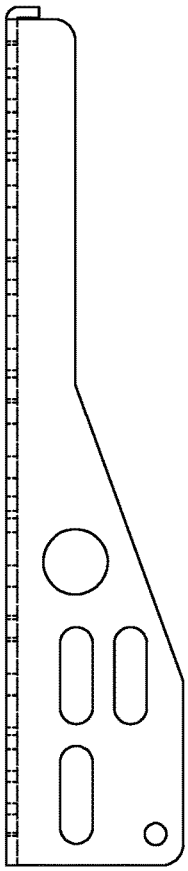
FIG. 10 is a side elevational view thereof.

This provides an open position of the platform extension that would be substantially perpendicular to the backpack frame 102. There is also a closed position which would fold up to be coplanar with the backpack frame 102. FIG. 10 is a first elevational view 1000 thereof. Sets 1030, 1040, 1050, 1060 are a series of pairs of horizontally-oriented-oval-shaped slots 920, 922 separated by series of vertically-oriented-oval-shaped slots 1031, 1041, 1051, 1071, 1091 are shown. The exact number of slots and sets of slots can vary depending on the overall dimensions of the frame.

Figure 11:
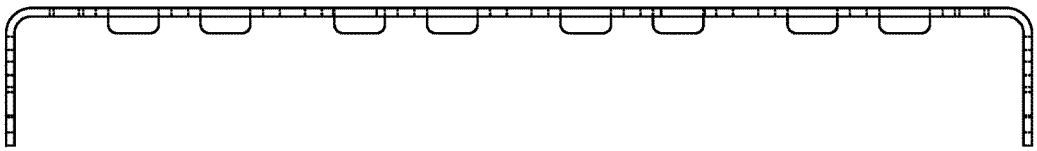
FIG. 11 is a top elevational view thereof.

FIG. 11 is a top elevational view thereof.

Non-Limiting Examples

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A backpack frame system comprising:

a substantially polygon main member formed from a single piece of material with a set of horizontally-oriented-oval-shaped slots and a set of vertically-oriented-oval-shaped slots, wherein at least some of the set of vertically-oriented-oval-shaped slots separate the horizontally-oriented oval-shaped slots, the substantially polygon main member including a top end and a bottom end and a front side and a back side, the back side for securing loads, the bottom end forming an obtuse angle in a direction towards the back side with the top end, the bottom end including a pair of mounting tabs disposed in a substantially perpendicular direction thereto, each of the pair of mounting tabs with a set of oval-shaped-slots and at least one circular slot, wherein the substantially polygon main member has a first back side, a first back top side, a second back top side, a third back top side, and a second back side which together form five sides of substantially octagon shape and each of the first back side, the first back top side, the second back top side, the third back top side, and the second back side include a rolled edge that is bent in a direction towards the back side and defines a first gap between the first back side and the first back top side, a second back gap between the first back top side and the second back top side, a third gap between the third back top side and the second back top side, and a fourth gap between the third back top side and the second back side; and an auxiliary substantially rectangular member with a set of horizontally-oriented oval-shaped slots and a set of vertically-oriented-oval-shaped slots, wherein at least some of the set of vertically-oriented-oval-shaped slots separate the set of horizontally-oriented-oval-shaped slots, the auxiliary substantially rectangular member including a side tabs disposed in a substantially perpendicular direction thereto, each of the side tabs with a set of oval-shaped-slots and at least one circular slot disposed in pattern to axially align with at least one of the set of oval-shaped-slots and the circular slot of the pair of mounting tabs so when mounted it can swing through approximately a ninety degree rotation.

2. The backpack frame system of claim 1, wherein two of the first back top side and the third back top side of the substantially octagon shape each include a reinforcement bracket.

3. The backpack frame system of claim 1, wherein the auxiliary substantially rectangular member is composed of metal, composite, plastic, or a combination thereof.

4. The backpack frame system of claim 1, wherein the substantially polygon main member is composed of metal, composite, plastic, or a combination thereof.

5. The backpack frame system of claim 1, further comprising:

a first reinforced side support mechanically fastened to one of the pair of mounting tabs and a second reinforced side support mechanically fastened to another of the pair of mounting tabs.

6. The backpack frame system of claim 1, wherein at least two out of the set of horizontally-oriented-oval-shaped slots are larger than the others in the set of horizontally-oriented-oval shaped slots and include reinforcement guides to surround the two out of the set of horizontally-oriented-oval shaped slots which are larger.

7. A backpack frame system comprising:

a substantially polygon main member formed from a single piece of material with a set of horizontally-oriented-oval-shaped slots and a set of vertically-oriented-oval-shaped slots, wherein at least some of the set of vertically-oriented-oval-shaped slots separate the horizontally-oriented oval-shaped slots, the substantially polygon main member including a top end and a bottom end and a front side and a back side, the back side for securing loads, the bottom end forming an obtuse angle in a direction towards the back side with the top end, the bottom end including a pair of mounting tabs disposed in a substantially perpendicular direction thereto, each of the pair of mounting tabs with a set of oval-shaped-slots and at least one circular slot, wherein the substantially polygon main member has a first back side, a first back top side, a second back top side, a third back top side, and a second back side which together form five sides of substantially octagon shape and each of the back side, the first back top side, the second back top side, the third back top side, and the second back side include a rolled edge that is bent in a direction towards the second back side and defines a first gap between the first back side and the first back top side, a second gap between the first back top side and the second back top side, a third gap between the third back top side and the second back top side, and a fourth gap between the third back top side and the second back side, wherein two of the first back top side and the third back top side of the substantially octagon shape each include a reinforcement bracket, and an auxiliary substantially rectangular member with a set of horizontally-oriented oval-shaped slots and a set of vertically-oriented-oval-shaped slots, wherein at least some of the set of vertically-oriented-oval-shaped slots separate the set of horizontally-oriented-oval-shaped slots, the auxiliary substantially rectangular member including a side tabs disposed in a substantially perpendicular direction thereto, each of the side tabs with a set of oval-shaped-slots and at least one circular slot disposed in pattern to axially align with at least one of the set of oval-shaped-slots and the circular slot of the pair of mounting tabs so when mounted it can swing through approximately a ninety degree rotation.

8. The backpack frame system of claim 7, wherein the auxiliary substantially rectangular member is composed of metal, composite, plastic, or a combination thereof.

9. The backpack frame system of claim 7, wherein the substantially polygon main member is composed of metal, composite, plastic, or a combination thereof.

10. The backpack frame system of claim 7, further comprising:

a first reinforced side support mechanically fastened to one of the pair of mounting tabs and a second reinforced side support mechanically fastened to another of the pair of mounting tabs.

11. The backpack frame system of claim 7, wherein at least two out of the set of horizontally-oriented-oval-shaped slots are larger than the others in the set of horizontally-oriented-oval shaped slots in the substantially polygon main member and include reinforcement guides to surround the two out of the set of horizontally-oriented-oval shaped slots which are larger in the substantially polygon main member.

* * * * *